United States Patent [19]

Lowenthal

[11] Patent Number: 4,487,570

[45] Date of Patent: Dec. 11, 1984

[54] SMOKERS LIGHTER

[75] Inventor: Hans Lowenthal, London, England

[73] Assignee: Colibri Lighters Limited, London, England

[21] Appl. No.: 197,827

[22] Filed: Oct. 17, 1980

[30] Foreign Application Priority Data

Oct. 31, 1979 [GB] United Kingdom ..... 7937673

[51] Int. Cl.[3] ..... F23Q 2/08

[52] U.S. Cl. ..... 431/130; 431/132; 431/134; 431/150; 431/153

[58] Field of Search ..... 431/130, 132, 145, 134, 431/135, 150, 152, 153, 256, 261, 267, 255; 361/260

[56] References Cited

U.S. PATENT DOCUMENTS

| | | | |
|---|---|---|---|
| 2,283,909 | 5/1942 | Bolle | 431/134 |
| 3,326,020 | 6/1967 | Steely | 431/130 |
| 3,610,793 | 10/1971 | Steuernagel et al. | 431/130 |
| 3,612,736 | 10/1971 | Steuernagel et al. | 431/130 |
| 3,679,346 | 7/1972 | Lambert | 431/130 |
| 3,734,680 | 5/1973 | Maruyama | 431/130 X |
| 3,744,958 | 7/1973 | Cobarg | 431/150 |
| 3,758,262 | 9/1973 | Harris | 431/130 |
| 4,076,491 | 2/1978 | Mohr | 431/130 |

FOREIGN PATENT DOCUMENTS

| | | | |
|---|---|---|---|
| 1250165 | 10/1971 | United Kingdom | 431/150 |

*Primary Examiner*—Randall L. Green

*Attorney, Agent, or Firm*—Robert E. Burns; Emmanuel J. Lobato; Bruce L. Adams

[57] ABSTRACT

A gas burning lighter with electrical spark ignition has a closed casing (11). Successive downward operative movements applied to an actuator slide (15) first releases a pivotal element (23) which moves outwards to an open position, creating a flame aperture (33) and opening a burner valve, and secondly operates a piezoelectric ignition mechanism to cause discharge of a spark and ignition of the gas to produce a flame (35).

19 Claims, 12 Drawing Figures

SMOKERS LIGHTER

BACKGROUND OF THE INVENTION

The invention relates to a gas burning smokers' lighter comprising a casing; a fuel reservoir with a valve which controls the discharge of fuel gas through a burner nozzle located within the casing; an electrical spark ignition system for igniting fuel gas leaving the burner nozzle; and manually operated actuating means causing the burner valve to open and the ignition system to operate. Such a lighter is hereinafter referred to as of the kind described.

Such lighters are subject to two important problems, which have not been solved wholly satisfactorily in the past. The first problem is the need to provide adequate protection for the delicate burner nozzle, burner valve, and sparking electrode(s). Such protection is important as experience shows that lighters frequently require maintenance because of an accumulation of foreign material adjacent to these parts or damage to these parts. The second problem is the difficulty in igniting the fuel gas first time upon operation of the ignition system. This arises because an electrical spark ignition system, such as a piezoelectric ignition system, usually produces a single spark for a short duration and the fuel gas/air mixture must be within a limited range of proportions in the immediate proximity of the spark if the gas is to be ignited. The difficulty is that the natural solution to the first problem is to enclose the burner nozzle and associated parts within a hollow upper part of a completely closed casing but this exacerbates the second problem by preventing the access of ignition air to the ignition zone adjacent to the burner nozzle until the casing is open to reveal the burner nozzle.

One solution has involved a so-called "fully automatic" lighter in which a finger piece actuating member forming a part of the closed casing is engaged and physically moved relatively to the rest of the casing against spring action. The movement of the actuating member itself reveals the burner nozzle and provides access for ignition air to the burner nozzle, the movement also causing opening of the burner valve and operation of the ignition system. When the actuating member is released, it makes a return stroke under the spring action so as to close the burner valve and casing. Such lighters suffer from the drawback that the speed at which the actuating member is moved by the user determines whether the access for ignition air has been sufficiently long before the ignition system is operated for the gas and air to have formed an ignitable mixture when the ignition spark is discharged. Also, and more importantly, the movement of the actuating member must necessarily be continued until the ignition system is operated, and in practice slightly beyond this point to ensure that the ignition system is operated in spite of any tolerances in the parts. It follows that the trailing end of the actuating member which usually forms the burner cover when closed and a boundary of the air inlet passage and flame aperture when open, is moving adjacent to and disturbing the gas/air mixture in the ignition zone right up to the moment at which the ignition spark is discharged. The operation of the known fully automatic lighters in thus uncertain and subject to the vagaries of the user, and they will not operate satisfactorily irrespective of the manner in which they are operated. As a result, fully automatic lighters have a reputation for not providing first time ignition with sufficient reliability.

Another solution involves the so-called "box-type" lighter in which the casing incorporates a hinged lid which is swung upwards or laterally to uncover the burner nozzle, and usually also to open the burner valve. However, the lid is a part vulnerable to damage and repair, is expensive and replacement thereof has involved replacement of the whole casing. Even if the swinging of the lid is responsible for opening the burner valve, this preliminary operation has to be followed by transference of the operator's thumb through an appreciable distance to a further actuating member for operating the ignition system and this has resulted in a somewhat tedious and clumsy manipulation of the lighter, as well as a waste of fuel gas prior to ignition. Further, in cases in which the lid has been swung upwards to uncover the burner nozzle, the lid has remained in an upwardly projecting position alongside the flame and has impeded the use of the flame. This solution, as that involving fully automatic lighters, is expensive in that the lid of the box type and the actuating member of the fully automatic lighter, which is displaced to uncover the burner nozzle, has needed to be large enough not only to cover the burner nozzle but to receive the user's thumb for displacement. Consequently the displacement part has provided such a relatively large proportion of the lighter casing that it has had to be embellished often in a similar manner to the rest of the casing and, being a separate part, this has involved two separate embellishment steps. If the embellishment involves any design which carries across the interface of the two parts, the embellishment becomes an even more expensive operation.

SUMMARY OF THE INVENTION

The object of the invention is to provide a construction which is less expensive than conventional lighters but which provides an ignition zone bounded by stationary parts and associated with an air inlet passage and flame aperture of accurately predetermined optimum size for such length of time before the ignition spark is discharged that, at that time, adequate air, and preferably an equilibrium mixture of gas and air, can be provided in the ignition zone with reasonable certainty.

In accordance with the present invention, a gas burning smokers' lighter of the kind described is characterised in that there is an opening adjacent to the top of the casing at a junction of at least two faces of the casing; in that an element is movably positioned at the opening and, prior to operation of the lighter, is held in a closed position in which it cooperates with the casing substantially to close the opening, the element moving outwardly of the casing transversely to the direction in which the flame is projected from the casing to an open position, such displacement both resulting in the provision at the opening of a flame aperture through which the flame can be projected and opening an air inlet passage for the ingress of ignition air to an ignition zone within the casing upstream of the flame aperture; and in that a part of the actuating means is separate from the element, is exposed at the outer surface of the casing and cooperates inside the casing with the element in such a way that a first operative movement applied to the actuating means part causes the element to move from its closed position to its substantially fully open position, and a subsequent second operative movement applied to the actuating means causes operation of the ignition system.

This construction provides a very neat way of substantially enclosing the burner nozzle and adjacent delicate parts, prior to operation of the lighter, while avoiding the problems of the prior art solutions. Thus in particular the provision of the element, which moves out of the closed casing to a predetermined protruding position upon initial operation of the lighter, ensures that an air inlet passage and flame aperture of predetermined size are automatically created upon initial operation, thereby providing the maximum time for ignition air to enter the ignition zone before the ignition spark is discharged, irrespective of how fast the user operates the actuating means. However, the element may be sufficiently small to preclude the necessity of embellishing the element identically to the rest of the lighter casing.

The element may carry a trailing part in which the flame aperture is permanently formed, this trailing part being drawn from a position, overlying, but preferably underlying, the casing into alignment with the burner nozzle, upon displacement of the element to its open position. Alternatively, the trailing part may overlie, but preferably underlie, and close a flame aperture in part of the casing until the element is displaced whereupon the trailing part is drawn away from and leaves the flame aperture unobstructed. Most simply however the opening is formed partly by a slot which is filled by a complementary part of the element in its closed position, the element moving along and at least partly out of the slot when moving to its open position to create the flame aperture between a trailing part of the element and the closed end of the slot. These constructions all provide a flame aperture of predetermined size, preferably with lateral dimensions between 3.5 and 6.5 mm., and preferably with a cross sectional area of between 20 and 30 $mm^2$. Thus when the flame aperture is created at the closed end of the slot, the slot part of the opening may have a width of between 3.5 and 6.5 mm. In any case, the part of the element adjacent to the flame aperture preferably moves transversely to the flame through a distance of between 3.5 and 6.5 mm when moving between its closed and open positions. An aperture of predetermined size can be arranged to ensure that the flame burns outside the casing and does not flicker back through the flame aperture into the casing. An evenly burning flame is also encouraged if the outer edge of the aperture is substantially at the same flame height position. For this reason when the flame aperture is created between a trailing part of the element and the closed end of the slot, the element preferably fills the slot with the outer surface of the element substantially flush with the corresponding casing face. It is not critical whether another part of the element overlies a casing face containing the opening but preferably the whole of the element fills the opening with its outer surface flush with the faces of the casing.

Although the opening may be formed at the junction of three faces of the casing, it is sufficient if the opening is formed at the junction of only two faces of the casing. The opening may then be a slot running around the angular or arcuate corner from one face into the other. Thus, if the casing, adjacent to the opening, is elongate in horizontal section, the opening may be provided at the junction of an upper and a narrower side face of the casing.

The element is preferably latched in its closed position and is released upon application of the first operative movement to the actuating means part whereupon the element springs out under spring action to its open position. This provides instant creation of the air inlet passage and flame aperture and hence the longest possible opportunity for air to flow into the ignition zone before sparking. In this case, the element may be held latched in its closed position by a catch which is released upon application of the first operative movement to the actuating means part, whereupon the element moves outwards under the spring urging. However, in a particularly simple construction, the element is latched in its closed position and urged to its open position by an over centre spring, the first operative movement applied to the actuating means part forcing the element to move past the dead centre position.

Alternatively, most of the advantages of the invention are obtained if the element moves to its open position throughout the first operative movement of the actuating means part. Stationary and predetermined conditions are still achieved in the ignition zone prior to beginning of the second operative movement to activate the ignition system. In this case the element may be urged to its closed position under spring action, the actuating member cooperating with the element, e.g. via a cam and follower, such that the element is pushed outwards to its open position during the first operative movement of the slide and is then held open against the spring urging during the second operative movement.

The element may be guided so as to slide along a straight or arcuate path. Preferably, however, it is pivoted about a horizontal or vertical axis internally of the casing but it will still be arranged so that, adjacent to the point at which the flame aperture is provided, the element moves substantially perpendicularly to the direction in which the flame is projected, at least during the initial part of its displacement to provide the flame aperture. The displacement of the element may be essentially laterally out of the wider or narrower side face of the casing in which case the operative movements applied to the actuating means are both preferably substantially vertical, particularly downwards, the actuating means cooperating with the element within the casing via some means, such as a cam and follower which convert the vertical movement to lateral movement. Alternatively the element may be displaced upwards, which would be appropriate in the case of a so-called pipe smokers' lighter in which the flame is projected laterally from adjacent the top of the casing.

It is convenient if, as seen perpendicularly both to the direction in which the flame is projected from the casing, and to the direction in which the element is moved outwardly of the casing, the actuating means part which is responsible for displacement of the element is offset relatively to the centre line of the flame in a direction opposite to that in which the element is moved outwardly of the casing away from the centre line of the flame. Thus if the lighter has a casing of rectangular prismatic form, an appropriate construction would involve projection of the flame upwardly from a flame aperture created in a top face of the casing, the element being displaced from a narrow edge of the top of the casing parallel to the centre line of the top of the casing. The actuating means part might then be mounted on a wider side face of the casing adjacent to the opposite narrower side face of the casing, or might work in an opening in the opposite narrower side face of the casing.

Similarly in the case of a pipe smokers' lighter, in which the flame is arranged to be projected laterally from an upper part of a narrower side face of the casing, the element may be displaced upwards to create a flame aperture upon the first operative movement being applied to an actuating means part mounted below the flame height, on a wide face of the casing.

The first operative movement applied to the actuating means part may cause only displacement of the element, and consequential creation of the flame aperture and air inlet passage. The burner valve may then be opened and the ignition system operated either simultaneously or successively upon application of the second operative movement to the actuating means. Preferably, however, the burner valve is opened substantially simultaneously with the displacement of the element to its open position, as a result of the first operative movement applied to the actuating means part. This contributes to even better "timing" of the lighter operation in that the fuel gas will be flowing from the burner nozzle almost as soon as the air inlet passage has been opened, so that a dynamic equilibrium mixture of gas and air will be formed in the ignition zone, prior to the subsequent sparking upon application of the second operative movement to the actuating means and hence operation of the ignition system. The burner valve may be arranged to remain open without the continued application of manual force to the actuating means and subsequently to be closed when the element is returned to its closed position, either upon retraction of the actuating means part, or by direct manual force applied to the element. The element, when in its protruding position, will then act as a flag indicating to the user that the burner valve is open and that gas is being discharged through the burner valve.

Both the first and second operative movements may be applied to a common actuating member of the actuating means, such as thumbpiece slide, which moves over a surface of the lighter and is connected to the element, to the burner valve, and to the ignition system within the casing by a connection extending through a second casing opening, such as a slot. The successive operative movements might then be applied by moving the slide progressively along the slot, or to and fro along the slot, by the user's thumb. Alternatively, the actuating means may incorporate two separate actuating members which operate in the same or separate casing openings. For ease of operation they are, however, preferably mounted adjacent to one another. When there are two actuating members, they will be intended to be operated in sequence and the first to be operated may be a button and will release the element to cause its displacement and provide the flame aperture, and possibly also open the burner valve. The second actuating member will then control the operation of the ignition system. When there are two actuating members, they are preferably immediately adjacent to one another so that there is a minimum of inconvenience in moving the user's thumb from the one to the other. When the actuating means comprises a slide member which is movable to open the burner valve, this movement may expose an indicator which is covered when the slide makes a return stroke upon reclosure of the burner valve. This provides a, or a further, warning to the user when the burner valve is open.

BRIEF DESCRIPTION OF THE DRAWINGS

Six examples of lighters constructed in accordance with the present invention are illustrated in the accompanying drawings, in which.

DESCRIPTION OF THE PREFERRED EMBODIMENT

Figure 1:
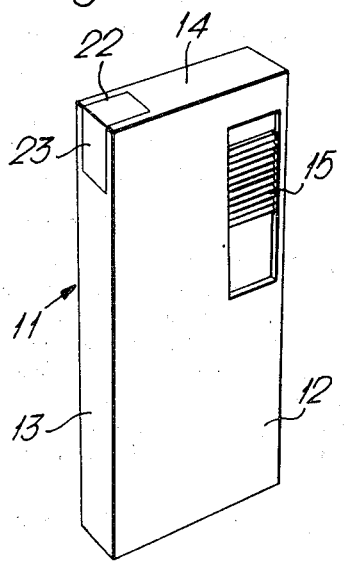
FIGS. 1 and 2 are perspective views showing the first example prior to and upon operation respectively.

Each of the illustrated examples of lighter has a rectangular prismatic box-shaped casing 11 with a wide front side face 12, a rear side face of similar size, two narrow side faces 13, and a top face 14. The casing has an actuating thumbpiece slide member 15 which can be pulled downwards by frictional entrainment by the user's thumb to operate the lighter. In examples one to four and six the slide is mounted on the front face 12 of the casing, and in the fifth example on a narrow side face 13. In the first three examples the slide member is recessed slightly into the casing face.

In each example the casing contains a liquefied gaseous fuel reservoir tank 16 having an inlet valve 17, and a burner valve 18 carrying a burner nozzle 19. The casing also contains a piezoelectric ignition unit 20 which is operated by depression of a plunger upon downward movement of the actuator slide 15, which is coupled to the plunger. The electrical output of the unit 20 is connected to the burner nozzle 19, and to an adjacent electrode 21.

Figure 2:
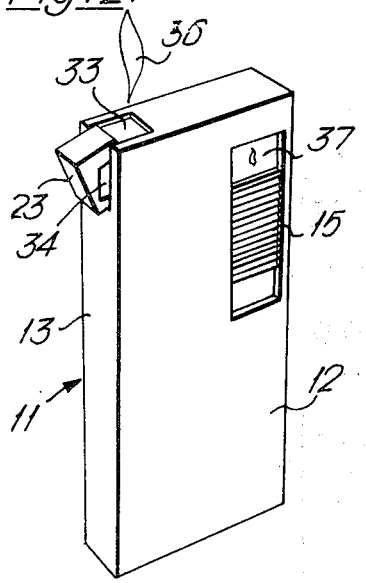
Figure 3:
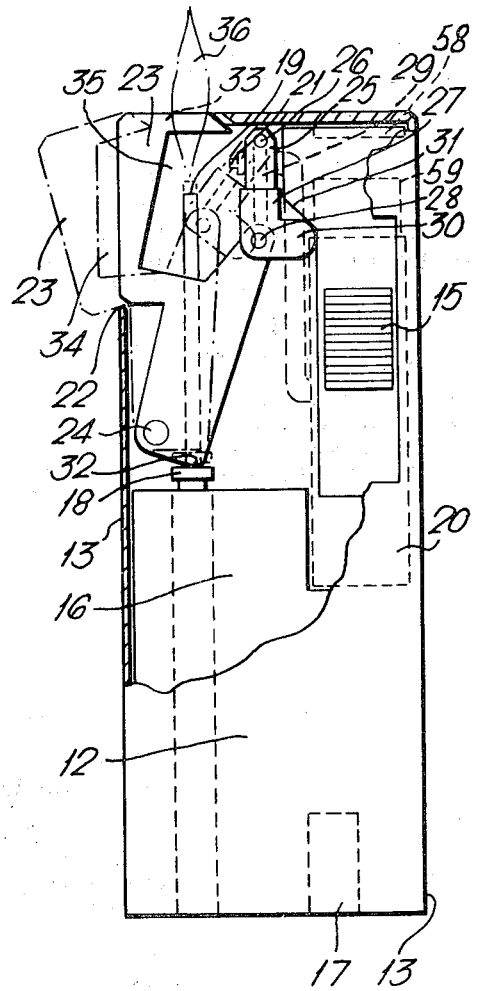
FIG. 3 is a partial vertical section through the FIG. 1 example.

An L-shaped slot opening 22 is formed in the casing at the junction of the faces 13 and 14 and in the rest position shown in FIG. 1 and in full lines in FIG. 3, the opening is filled by a G-shaped closure element 23, the outer surface of which is then flush with the surfaces 13 and 14. The closure element is pivotally mounted within the casing about an axis 24 so as to be capable of pivoting between the closed position shown in FIG. 1 and in full lines in FIG. 3, and an open position shown in FIG. 2 and in chain dotted lines in FIG. 3. The closure element is latched in both its open and closed positions by bistable biasing means in the form of an over centre spring arrangement comprising one link 25 which is pivoted within the casing at 26 and which cooperates telescopically with a second link 27 pivoted at 28 to the element 23. A helically coiled compression spring 29 is contained within the links 25 and 27 so as to urge them apart. It will be appreciated that as the element pivots through a dead centre position, the spring 29 is compressed and then allowed to expand.

The link 27 has a lateral arm 30 cooperating with an inclined cam surface 31 on the slide 15. The element 23 also has a bifurcated cam foot 32 which straddles the nozzle 19 and engages a flange at the top of the burner valve 18. In its closed position, the element 23 holds the flange down and the burner valve closed but when the element moves to its open position, it allows the burner valve flange to rise and the valve to open so that gas is discharged through the nozzle 19.

Starting from the closed position shown in FIG. 1 and in full lines in FIG. 3, the lighter is operated by drawing the actuator slide downwards. During the first part of this stroke, the cam surface 31 forces the link 27 to the left as shown in FIG. 3, thereby causing the element to tilt in the same direction. When the dead centre position of the spring 29 is passed the element becomes unlatched and jumps out to its open position both under the action of the spring 29 and under the action of the internal spring in the burner valve 18. This movement causes the upper part of the element 23 to be withdrawn almost completely out of the part of the slot 22 in the upper face 14, thereby creating a flame aperture 33 of predetermined length and width, and also creating on each side air inlet passages 34 into an ignition zone 35 around the burner nozzle 19 as a result of the inner wall of the element 23 moving outwardly of the adjacent side face 13. Simultaneously the release of the burner valve causes gas to be discharged through the nozzle into the ignition zone 35. Continued downward movement of the actuating slide 15 causes an overhanging part 58 at the top of the slide to engage and push down on a plunger 59 of the piezoelectric unit 20 until the unit is actuated and a spark is discharged between the electrode 21 and the nozzle 19, thereby igniting a flame 36. Upon release of the slide 15, it will move back partway upwards to the FIG. 2 position under the action of the return spring of the plunger of the piezoelectric unit 20.

The flame will continue to burn and the element 23 will remain in its protruding position without the application of further pressure to the actuating slide 15. When it is subsequently desired to shut off the flame, the user applies his thumb to the left hand edge of the element 23 as shown in FIG. 3 and pushes it back into the casing. This presses down the burner valve flange thereby shutting off the gas flow and flame, forces the links 25 and 27 back past the dead centre position so that the spring 29 is then urging the element 23 inwards, and forces the actuator slide to its uppermost position as a result of the engagement between the arm 30 and the cam 31. Apart from the protrusion of the element 23, which acts as a flag indicator when the burner valve 18 is open, an indicator 37 is also provided in the recess for the actuator slide 15. This indicator may carry some message such as "gas open", or exhibit a picture of a flame, and will be brightly coloured, e.g. red. The indicator will thus be revealed when the slide 15 is in its mid-position or lower but covered when the slide has been forced to its uppermost position upon return of the element 23 to its closed position.

Figure 4:
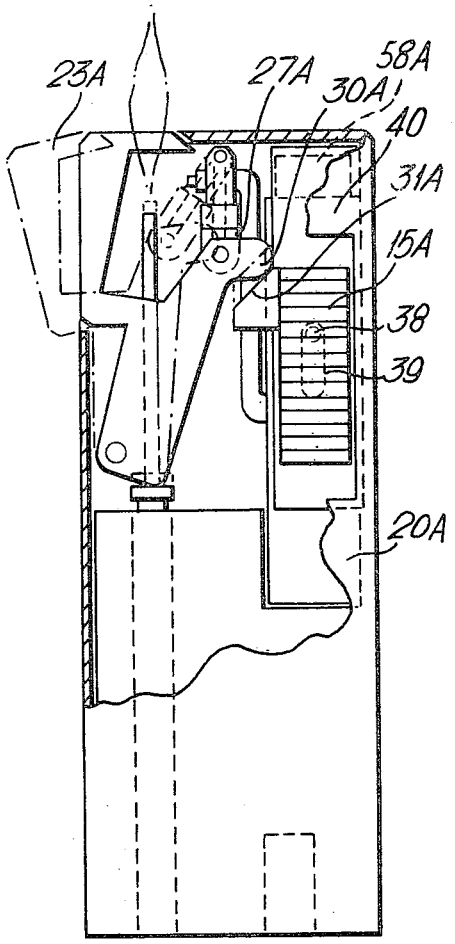
FIG. 4 is a partial section similar to FIG. 3 but showing a modification.

The second example illustrated in FIG. 4 is very similar to the first example and only the differences will be described. Parts analogous to parts in the first example bear the same reference numeral with the suffix A. A similar procedure will be adopted for the subsequent examples but with suffixes B, C etc.

The actuator is again a slide 15A but in this case it carries an inclined cam surface 31A which cooperates with a projecting arm 30A which is carried by the element 23A, rather than by the link 27A. The actuator slide 15A is thus moved upwards from its rest position to release the element and cause the burner valve to open.

The actuator slide 15A carries a pin 38 which works in a slot 39 in an auxiliary actuator slide 40 mounted behind the slide 15A. When the slide 15A is moved upwards to release the element 23A the slide 40 is not moved. The piezoelectric unit 20A is operated to cause discharge of the ignition spark by subsequently moving slide 15A down further than it had previously been moved up, so that the pin 38 engages in the bottom of the slot 39 and the slide 40 is thereafter carried downwards with the slide 15A, and carries the plunger 58A of the unit 20A downwards. Removal of the user's thumb from the slide 15A then causes both slides to move back to the position illustrated in FIG. 4, under the action of the return spring in the unit 20A. In this example there will be no indicator equivalent to the indicator 37.

Figure 5:
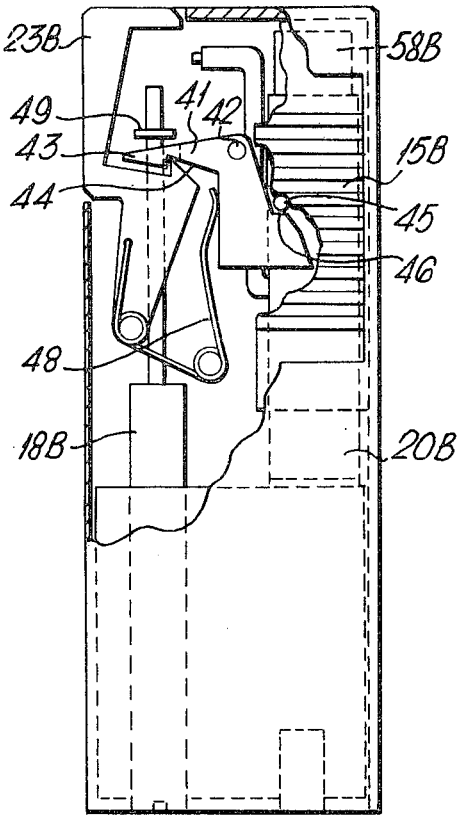
FIG. 5 is a partial section similar to FIGS. 3 and 4 but of the third example prior to operation.
Figure 6:
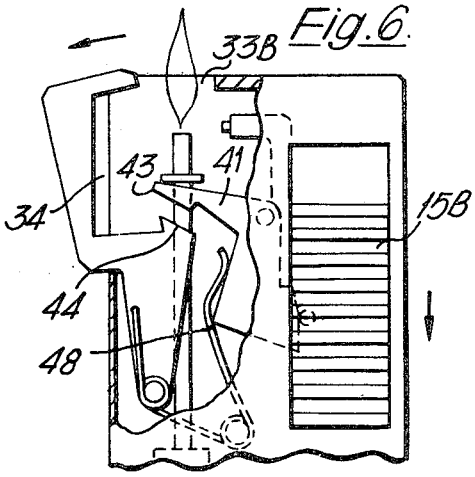
FIG. 6 is a partial section corresponding to the upper part of FIG. 5 but showing the lighter upon operation.

FIG. 5 and 6 show a third example which is another modification of the first example and only the differences will be described.

In this example the element 23B is held latched in its closed position, not by an over centre spring arrangement, but by a catch member 41 which is pivoted in the casing about an axis 42 and has a hook end 43 cooperating with a hook 44 on the element 23B. The actuator slide 15B carries a pin 45 which engages with a shoulder 46 on the catch member 41. Both the catch member 41 and the element 23B are urged to rotate in the counterclockwise direction as seen in FIG. 5 by the respective arms of a hairpin torsion spring 48.

In the rest position shown in FIG. 5, the hook end 43 engages over the hook 44 to hold the element 23B closed. When the actuator slide 15B is drawn downwards the pin 45 pushes down on, and then rides over, the shoulder 46, causing the catch member 41 to rotate in the clockwise direction against the action of the spring 48. This movement disengages the hook end 43 from the hook 44 so that the element jumps outwards to its FIG. 6 position. Simultaneously the catch member 41 engages beneath a flange 49 on the burner nozzle, lifting the burner nozzle and hence opening the burner valve 18B. Further downward movement of the actuator slide 15B depresses the plunger 58B of the piezoelectric unit 20B and causes discharge of the ignition spark. The lighter is a semiautomatic lighter in the sense that although the actuator slide 15B may be allowed to rise slightly under the action of the return spring for the plunger of the unit 20B, continued downward pressure must be applied to the slide 15B to maintain the burner valve open so that the flame continues to burn. As soon as the user removes thumb pressure from the slide 15B, the spring 48 rotates the catch member 41 in the counterclockwise direction, thus causing the slide 15B to rise to its rest position and allowing the burner valve 18B to close under its internal spring reaction. The element 23B is subsequently returned to its rest position by manual pressure applied to the left hand side of the element as shown in FIGS. 5 and 6. As the element approaches its fully closed position, the hook end 43 is caused to lift slightly as it rides over the hook 44 against the action of the spring 48 until the hook end 43 snaps over the hook 44 to lock the element in its closed position.

Figure 7:
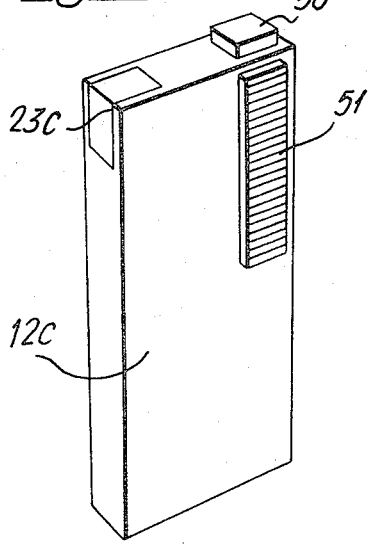
FIGS. 7 and 8 are perspective views similar to FIGS. 1 and 2 but of the fourth example.
Figure 8:
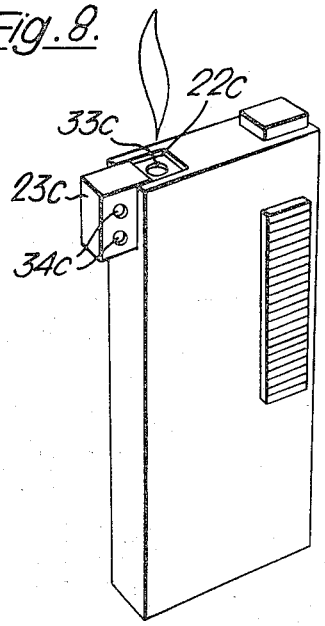

FIGS. 7 and 8 show an alternative construction in which the element 23C is mounted in a similar position to the element 23 but is guided so as to slide linearly to its protruding position shown in FIG. 8, again under spring action upon being unlatched. In this case the flame aperture 33C is provided in a trailing portion of the element and is exposed in the opening 22C. Air inlet passages 34C are provided through holes exposed when the element 23C is in its protruding position, and leading through a hollow interior of the element to the ignition zone. This example of lighter has two actuator parts, a plunger 50 and a slide 51. To operate the lighter the user places his thumb on top of the plunger 50 and presses downwards, this action releasing the element 23C, the thumb movement continuing down over and onto the slide 51 which is drawn downwards to depress a plunger of a piezoelectric unit.

Figure 9:
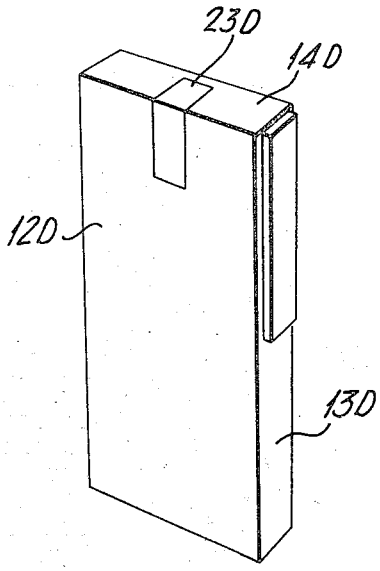
FIGS. 9 and 10 are perspective views similar to FIGS. 7 and 8 but of the fifth example; and, FIGS. 11 and 12 are partial sections similar to FIG. 3 but showing the sixth example prior to and after operation respectively.
Figure 10:
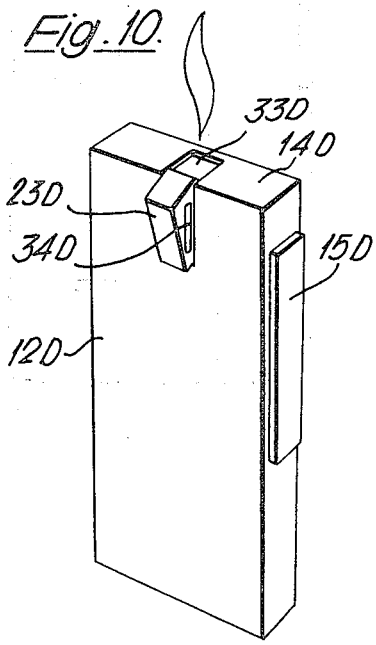

In the fifth example, illustrated in FIGS. 9 and 10, the element 23D is pivotally mounted similarly to the element 23 but in an opening at the junction of an upper or tap face 14D and a wide front face 12D of the casing. On the tap face 14D a flame aperture 33D is created when the element is released and jumps partly out of the front face of the casing. In this position air inlet passages 34D are provided to the inlet zone through slots in the sides of the element 23D, leading through the interior of the element. In this example the element is released and the burner valve opened, and the piezoelectric unit is subsequently operated, by the successive two stage downward movement of an actuator slide 15D, mounted at a narrower side face 13D of the casing, in an analogous manner to the first example.

Figure 11:
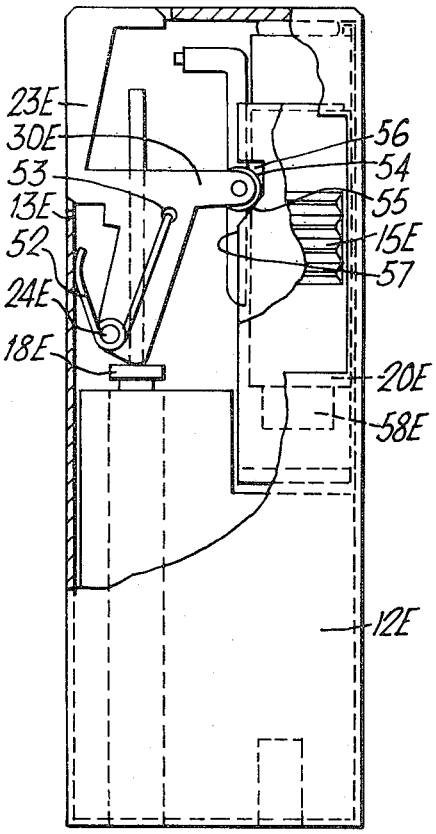
Figure 12:
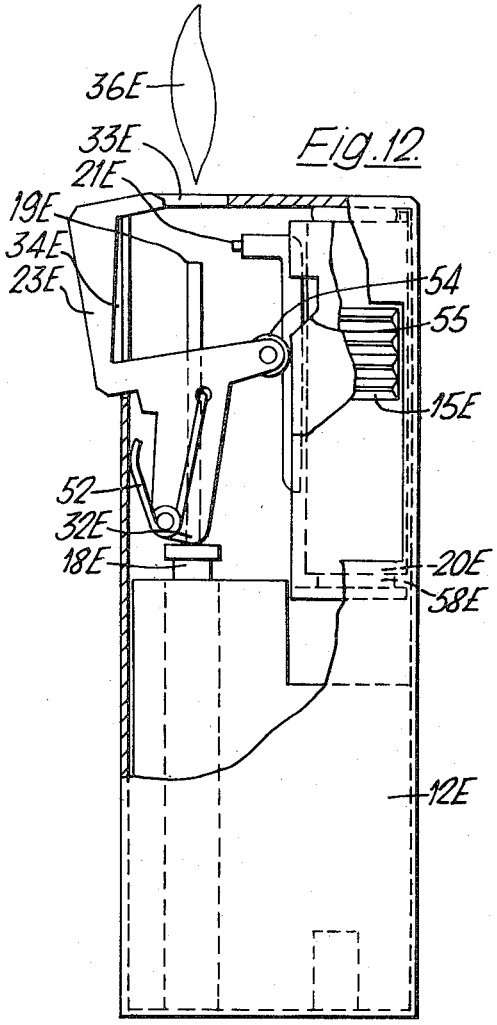

The sixth example, illustrated in FIGS. 11 and 12, has similarities with the first and second examples, but one difference is that the element 23E is continuously urged to its closed position shown in FIG. 11 by a hairpin torsion spring 52 which is mounted on the element pivot 24E and has one arm bearing against the casing wall 13E and the other arm engaging in an aperture 53 in the element.

Similarly to the FIG. 4 example, the element 23E has a projecting arm 30E carrying a cam follower roller 54 which runs on a cam surface of the actuator slide 15E. The cam surface incorporates an inclined portion 55 leading out of a notch 56 in the actuator onto a vertical portion 57.

Starting from the rest position shown in FIG. 11, the lighter is operated by pushing the actuator slide 15E upwards. This initially causes the element 23E to swing out to its open position shown in FIG. 12, as the roller 54 rides up the inclined cam portion 55, thereby creating the flame aperture 33E and air inlet passages 34E. When the roller 54 reaches the lower end of the inclined cam portion 55, it rides onto vertical portion 57. Thereafter further upward movement of the slide 15E leaves the element 23E stationary in its fully open position. Such further upward movement of the actuator slide 15E is necessary then to pick up and raise the plunger 58E of an inverted piezoelectric ignition unit 20E, until a spark is discharged between the burner nozzle 19E and electrode 21E to ignite the flame 36E.

This example of lighter is fully automatic in the sense that continued upward pressure must be applied to the actuator slide 15E to maintain the element 23E open and the flame 36E burning. As soon as the slide is released, it moves downwards initially under the return spring for the plunger 58E, and subsequently when the roller 54 reaches the inclined cam portion 55, under the reaction of the spring 52 which tends to return the element 23E to its closed position. The spring 52 is stronger than the spring in the burner valve 18E so that the burner valve is pushed downwards to close the valve by the foot 32E of the element 23E when the element is pivoted back to its closed position.

I claim:

1. A smokers' lighter of the type having a casing which contains therein a burner nozzle through which fuel gas discharges from a fuel reservoir under control, of a burner valve, and having an actuatable electrical spark ignition system operative when actuated to ignite fuel gas discharged through the burner nozzle to form a flame: means defining a flame opening at the upper part of the casing at a junction of at least two faces of the casing and through which the flame projects during use of the lighter; a flame opening closure element having a normally closed position for substantially closing the flame opening and movable relative to the casing in a lateral direction with respect to the flame direction to an open position in which the closure element projects laterally of the casing for opening the flame opening and thereupon also providing a separate air inlet passage for admitting ignition air into the casing to an ignition zone in the vicinity and laterally of the burner nozzle; and manually-actuated means including an actuating member disposed at an outer surface of the casing and movable relative to the casing independently of the closure element for effecting movement of the closure element from its closed position to its fully open position in response to a first operative movement of the actuating member and for thereafter effecting actuation of the electrical spark ignition system to discharge an ignition spark in response to a subsequent second operative movement of the actuating member, the closure element remaining substantially stationary relative to the casing during the second operative movement of the actuating member.

2. A smokers' lighter according to claim 1; wherein the closure elements has an outer surface configured so as to lie substantially flush with the said at least two faces of the casing when the closure means is in its closed position.

3. A smokers' lighter according to claim 1; wherein the means defining the flame opening comprises a pair of slots one in each of said two faces of the casing, the pair of slots intersecting with one another at the junction of said two faces.

4. A smokers' lighter according to claim 3; wherein the slot part of the flame opening through which the flame projects has a width of between 3.5 and 6.5 mm.

5. A smokers' lighter according to claim 3; wherein the slot part of the flame opening through which the flame projects is disposed at the top end face of the casing.

6. A smokers' lighter according to claim 1; wherein the burner valve comprises an actuatable burner valve operative when actuated to an open state to permit the flow of fuel gas from the fuel reservoir out through the burner nozzle; means for biasing the burner valve to a closed state; and wherein the manually-actuated means includes means for actuating the burner valve to its open state in response to the first operative movement of the actuating member.

7. A smokers' lighter according to claim 6; further including means for maintaining the burner valve in its open state without the continued application of manual force to the actuating member after the actuating member has undergone its first operative movement, and elements for returning the burner valve to its closed state when the closure means moves from its open position to its closed position.

8. A smokers' lighter according to claim 1; wherein the manually-actuated means includes latching means for releasably latching the closure elements in its closed position.

9. A smokers' lighter according to claim 8; wherein the latching means comprises a linkage system interconnecting the closure element and actuating member such that the first operative movement of the actuating member unlatches the closure element, and bistable biasing means having one stable state for biasing the linkage system so as to releasably latch the closure element in its closed position and another stable state for biasing the linkage system so as to bias the closure means to its open position.

10. A smokers' lighter according to claim 9; wherein the linkage system includes a pair of pivotal links telescopically connected together.

11. A smokers' lighter according to claim 1; wherein the manually-actuated means includes means mounting the actuating member for sliding movement on the casing at a location remote from the closure element.

12. A smokers' lighter according to claim 1; wherein the closure element comprises a pivotal closure element pivotally mounted within the casing so as to undergo pivotal movement in a lateral direction relative to the flame direction between closed and open positions, the closure element being configured to fit within and substantially close the flame opening when in the closed position and being configured to define an air inlet passage for admitting ignition air into the casing to the ignition zone when in the open position.

13. A smokers' lighter according to claim 12; wherein the closure element has means extending through the interior thereof for defining the air inlet passage.

14. A smokers' lighter according to claim 1; wherein the actuating member is movably disposed on a given face of the casing different from said two faces which define the flame opening.

15. A smokers' lighter according to claim 14; wherein the manually-actuated means includes means mounting the actuating member for manual sliding displacement along the given face of the casing to effect the first and second operative movements of the actuating member.

16. A smokers' lighter according to claim 15; wherein the casing comprises top, bottom and side faces rigidly interconnected to define the casing.

17. A smokers' lighter according to claim 14; wherein the casing comprises top, bottom and side faces rigidly interconnected to define the casing.

18. A smokers' lighter according to claim 1; wherein the casing comprises top, bottom and side faces rigidly interconnected to define the casing.

19. A smokers' lighter according to claim 1; wherein the manually-actuated means includes means mounting the actuating member for manual sliding displacement along a given face of the casing to effect the first and second operative movements of the actuating member.

* * * * *